US009238903B2

(12) United States Patent
Saito

(10) Patent No.: US 9,238,903 B2
(45) Date of Patent: Jan. 19, 2016

(54) CONTROL METHOD AND CONTROL APPARATUS FOR WORK VEHICLE

(75) Inventor: Yoshiaki Saito, Kawaguchi (JP)

(73) Assignee: KOMATSU LTD., Tokyo (JP)

( * ) Notice: Subject to any disclaimer, the term of this patent is extended or adjusted under 35 U.S.C. 154(b) by 1067 days.

(21) Appl. No.: 13/258,738

(22) PCT Filed: Mar. 25, 2010

(86) PCT No.: PCT/JP2010/055267

§ 371 (c)(1),
(2), (4) Date: Sep. 22, 2011

(87) PCT Pub. No.: WO2010/110386

PCT Pub. Date: Sep. 30, 2010

(65) Prior Publication Data

US 2012/0024146 A1 Feb. 2, 2012

(30) Foreign Application Priority Data

Mar. 26, 2009 (JP) ..... 2009-076570

(51) Int. Cl.
*E02F 3/43* (2006.01)
*E02F 9/22* (2006.01)

(52) U.S. Cl.
CPC ..... *E02F 9/2203* (2013.01); *E02F 3/431* (2013.01); *E02F 9/2296* (2013.01)

(58) Field of Classification Search
CPC ..... E02F 3/431
USPC ..... 414/701
See application file for complete search history.

(56) References Cited

U.S. PATENT DOCUMENTS 3,522,897 A * 8/1970 Freedy ..... 414/701
5,083,894 A * 1/1992 Ikari et al. ..... 414/701
6,951,067 B1 * 10/2005 Dietz et al. ..... 37/348

FOREIGN PATENT DOCUMENTS

JP 54-125994 9/1979
JP 59-43567 3/1984
JP 60-128001 8/1985
JP 2002-54609 2/2002

OTHER PUBLICATIONS

International Search Report mailed Jul. 6, 2010.

* cited by examiner

*Primary Examiner* — F. Daniel Lopez
(74) *Attorney, Agent, or Firm* — Kratz, Quintos & Hanson, LLP

(57) ABSTRACT

The present invention provides a control method and a control apparatus for a vehicle that make it possible to moderate or completely eliminate the impacts generated when the bucket is operated in a tilt direction, from a state in which the bucket in a dump position is forcibly actuated in the tilt direction and the bucket hydraulic cylinder is pressurized by the lifting operation of the boom and also to perform the boom lifting operation with good operability and workability. Control is performed to supply a pressure oil to the bucket hydraulic cylinder so as to actuate the bucket hydraulic cylinder in the tilt direction when a work equipment is being actuated in an actuation region close to an actuation region in which the bucket is forcibly actuated in the tilt direction by lifting the boom in a state in which the bucket is operated to a neutral position or dump operated, or when the bucket is being actuated in the tilt direction in the actuation region in which the bucket is forcibly actuated in the tilt direction. Further, a pressure oil supplied to the bucket hydraulic cylinder is controlled so as to restrict an actuation speed of the bucket hydraulic cylinder in a dump direction when [the work equipment] being actuated in an actuation region close to an actuation region in which the bucket is forcibly actuated in the tilt direction by operating the boom to a neutral position or lowering the boom in a state in which the bucket is dump operated.

5 Claims, 10 Drawing Sheets

| BOOM ANGLE θ [deg] | BUCKET CYLINDER STROKE L [mm] |
|---|---|
| -50 | 1650 |
| 0 | 1650 |
| 10 | 1650 |
| 15 | 1650 |
| 19 | 1650 |
| 22 | 1670 |
| 47 | 1870 |
| 50 | 1894 |

| NECESSARY STROKE ΔL [mm] | BUCKET TILT TARGET FLOW RATE $Q_t$ [%] |
|---|---|
| 0 | 35 |
| 10 | 35 |
| 20 | 30 |
| 30 | 20 |
| 40 | 5 |
| ΔLc 50 | 0 |
| 60 | 0 |
| 70 | 0 |
| 80 | 0 |
| 90 | 0 |
| 100 | 0 |

| NECESSARY STROKE ΔL [mm] | BUCKET DUMP TARGET FLOW RATE $Q_d$ [%] |
|---|---|
| 0 | 10 |
| 10 | 20 |
| 20 | 30 |
| 30 | 40 |
| 40 | 50 |
| ΔLc 50 | 100 |
| 60 | 100 |
| 70 | 100 |
| 80 | 100 |
| 90 | 100 |
| 100 | 100 |

| BOOM ANGLE θ [deg] | BUCKET CYLINDER STROKE L [mm] |
|---|---|
| -50 | 1650 |
| 0 | 1650 |
| 10 | 1650 |
| 15 | 1650 |
| 19 | 1650 |
| 20 | 1650 |
| 48 | 1870 |
| 50 | 1890 |

FIG.10A

| NECESSARY STROKE ΔL [mm] | BUCKET TILT TARGET FLOW RATE $Q_t$ [%] |
|---|---|
| 0 | 30 |
| 10 | 20 |
| 20 | 10 |
| ΔLc 30 | 0 |
| 40 | 0 |
| 50 | 0 |
| 60 | 0 |
| 70 | 0 |
| 80 | 0 |
| 90 | 0 |
| 100 | 0 |

FIG.10B

| NECESSARY STROKE ΔL [mm] | BUCKET DUMP TARGET FLOW RATE $Q_d$ [%] |
|---|---|
| 0 | 10 |
| 10 | 30 |
| 20 | 50 |
| ΔLc 30 | 100 |
| 40 | 100 |
| 50 | 100 |
| 60 | 100 |
| 70 | 100 |
| 80 | 100 |
| 90 | 100 |
| 100 | 100 |

FIG.10C

CONTROL METHOD AND CONTROL APPARATUS FOR WORK VEHICLE

TECHNICAL FIELD

The present invention relates to a control method and a control apparatus for a work vehicle that are applicable to a work vehicle of a structure in which a bucket in a dump position is forcibly actuated in the tilt direction and a bucket hydraulic cylinder is pressurized by the lifting operation of a boom, due to a mechanism limit of a work equipment constituted by the bucket and the boom.

BACKGROUND ART

FIG. 1 shows the structure of a work equipment 2 provided in the front portion of a vehicle body 1*a* of a wheel loader 1.

As shown in FIG. 1, the work equipment 2 is constituted by a boom 3 and a bucket 4. The base of the boom 3 is attached to the vehicle body 1*a* so that the boom can be rotated up and down, and the bucket 4 is attached to the distal end of the boom 3 so as to be rotatable in the dump direction and tilt direction.

A rod 5*a* of the boom hydraulic cylinder 5 is attached to the boom 3, and a body 5*b* of the boom hydraulic cylinder 5 is attached to the vehicle body 1*a*. Where the rod 5*a* of the boom hydraulic cylinder 5 is extended, the boom 3 is actuated up, and where the rod 5*a* of the boom hydraulic cylinder 5 is contracted, the boom 3 is actuated down.

A bell crank 7 is swingably attached to the boom 3. A rod 6*a* of a bucket hydraulic cylinder 6 is attached to one side in the longitudinal direction of the bell crank 7. A body 6*b* of the bucket hydraulic cylinder 6 is attached to the vehicle body 1*a*. One end of a rod 8 is attached to the other end in the longitudinal direction of the bell crank 7, and the other end of the rod 8 is attached to the bucket 4. Where the rod 6*a* of the bucket hydraulic cylinder 6 is extended, the bucket 4 is actuated in the tilt direction, and where the rod 6*a* of the bucket hydraulic cylinder 6 is contracted, the bucket 4 is actuated in the dump direction.

The boom 3 rotates about a rotary shaft 3*a* located at the base thereof, and a boom angle sensor 9 that detects a rotation angle θ (referred to hereinbelow as boom angle θ) of the boom 3 is provided at the rotary shaft 3*a*.

The bucket 4 rotates following the swinging of the bell crank 7, and a bell crank angle sensor 10 that detects a swinging angle ϕ (referred to hereinbelow as bell crank angle ϕ) of the bell crank 7 is provided at a swinging shaft 7*a* of the bell crank 7.

A stroke L of the bucket hydraulic cylinder 6 can be uniquely calculated on the basis of the boom angle θ, bell crank angle ϕ, and well-known data relating to the link mechanism including the bell crank 7 and the rod 8.

The boom 3 is actuated by operating a boom operation lever 11 provided in an control cabin. The bucket 4 is actuated by operating a bucket operation lever 12 provided in the control cabin.

Patent Document 1 indicated hereinbelow describes the invention relating to a hydraulic shovel equipped with a work equipment having a structure in which the body of a boom hydraulic cylinder is attached to a vehicle body, the body of an arm hydraulic cylinder is attached to the boom, and a bucket hydraulic cylinder is attached to an arm. In this hydraulic shovel, a pressure oil is supplied by small amounts via a throttle to the hydraulic cylinder when the work equipment is actuated in order to restrict the abrupt outflow of the pressure oil maintained between the hydraulic cylinder and the flow rate directional control valve and moderate the impact acting upon the vehicle body when the work equipment is stopped.

Patent Document 1: Japanese Patent Application Laid-open No. 2002-54609.

DISCLOSURE OF THE INVENTION

In the work equipment 2 of the structure shown in FIG. 1, the following phenomenon is caused by the mechanism limit of the work equipment 2. Thus, because of the lifting operation of the boom 3, the bucket in the dump position is forcibly actuated in the tilt direction and a head chamber 6H of the bucket hydraulic cylinder 6 (see FIG. 2A) is pressurized.

Thus, when soil or sand is loaded into the vessel of a dump truck and discharged, the work equipment 2 is in a full-dump posture in which the bucket hydraulic cylinder 6 is retracted to the maximum. In this case, the operator sometimes operates the boom operation lever 11 and lifts the boom 3 to the limit, while the bucket 4 is in the full-dump posture, in order to adjust the load or pull out the bucket 4 hanging on the vessel. When the bucket operation lever 12 is in the neutral state and the boom 3 is lifted, because the bucket hydraulic cylinder 6 is fixed, the bell crank 7 rotates in the direction of abutment against a dump stopper 3*d*. Where the bell crank 7 abuts against the dump stopper 3*d* when the boom 3 is lifted, the boom 3 and the bell crank 7 are lifted together. In this case, the rod 6*a* of the bucket hydraulic cylinder 6 is actuated to be drawn out by the bell crank 7.

Thus, the bell crank 7 abuts against the stopper 3*d* on the boom 3 (see FIG. 7B), and then because of the structure of the work equipment 2 the rod 6*a* of the bucket hydraulic cylinder 6 is drawn out and the bucket 4 in the dump position is forcibly moved upward toward the tilt direction by the force lifting the boom 3, even though the pressure oil is not supplied in the direction of tilting the bucket 4.

For this reason, in a state in which the head chamber 6H of the bucket hydraulic cylinder 6 is closed as shown in FIG. 2A, the rod 6*a* is drawn out, the head chamber 6H is compressed and pressurized, and the oil pressure P on the head chamber 6H side increases. In this case the oil pressure of the bottom chamber 6B becomes zero.

In this state, the operator sometimes operates the bucket operation lever 12 and actuates the bucket 4 in the tilt direction. In such a case, the opening of the bucket control valve 16 is open as shown in FIG. 2B, the head chamber 6H that is under high pressure is opened to the atmosphere, the oil pressure in the head chamber 6H changes from the high pressure P to 0, and the oil pressure in the bottom chamber 6B changes from 0 to the high pressure P. The bucket hydraulic cylinder 6 vibrates due to reaction to such abrupt and large changes in the oil pressure. Such vibrations are transmitted to the vehicle body 1*a*, and the vehicle body 1*a* swings in the front-rear direction. When the boom 3 is lifted, the center of gravity of the wheel loader 1 is high and unstable and the applied vibrations create a large impact acting upon the vehicle body 1*a* and the operator.

The phenomenon of the enclosed high-pressure oil being released when the bucket operation lever 12 is operated is also observed in other cases. Thus, in a state in which the boom 3 is lowered, the bucket 4 is sometimes forcibly actuated toward the dump side, even though the bucket 4 is tilted. Where the bucket operation lever 12 is operated in the dump direction in this case, the oil pressure changes abruptly. However, in this case, the boom 3 is lowered and therefore the center of gravity is low and stable. As a result, even though the impact acting upon the vehicle body 1*a* is small, the operator has a feeling of uneasiness and fatigue. Further, the bucket operation lever 12 is sometimes operated and the bucket 4 is actuated in the dump direction in a state in which the boom operation lever 11 is set to neutral and not operated and the boom 3 is stopped. Where the bucket 4 is actuated in the dump direction and the bell crank 7 abuts against the stopper 3*d*, the bell crank 7 stops. However, since the bucket operation lever 12 is operated in the dump direction, the supply of the pressure oil to the head chamber 6H of the bucket hydraulic cylinder 6 is continued and the pressure in the head chamber 6H increases. In this state, the operator sometimes operates the bucket operation lever 12 to actuate the bucket 4 in the tilt direction. As a result, the state shown in FIG. 2B is similarly assumed, and a large impact acts upon the vehicle body 1*a* and the operator.

Furthermore, after the bell crank 7 has abutted against the stopper, the rod 6*a* of the bucket hydraulic cylinder 6 in which the head chamber 6H is pressurized by the force lifting the boom 3 is forcibly drawn out.

The resultant problem is that the boom 3 is difficult to lift and the operability and workability are degraded.

The present invention has been created with the foregoing in view and it is an object thereof to moderate or completely eliminate the impacts generated when the bucket is operated in the tilt direction from a state in which the bucket in a dump position is forcibly actuated in the tilt direction and the bucket hydraulic cylinder is pressurized by the lifting operation of the boom, and also to perform the boom lifting operation with good operability and workability.

Further, in Patent Document 1, a hydraulic shovel (a work vehicle equipped with a work equipment of a structure in which the body of the boom hydraulic cylinder is attached to the vehicle body, the body of the arm hydraulic cylinder is attached to the boom, and the bucket hydraulic cylinder is attached to the arm) is assumed. The work equipment of such a structure can never be in "the state in which the bucket in a dump position is forcibly actuated in the tilt direction and the bucket hydraulic cylinder is pressurized by the lifting operation of the boom", which is assumed in the present invention. Therefore, the aforementioned patent document does not suggest in any way the object of the present invention which is to moderate the impacts when the bucket is operated in the tilt direction from a pressurized state of the bucket hydraulic cylinder.

Furthermore, in the configuration described in Patent Document 1, the flow rate of pressure oil supplied to the hydraulic cylinder for the work equipment is throttled when the operation is started, and the decrease in actuation speed and degradation of workability cannot be avoided. Therefore, the object of the present invention, which is to increase operability, is inherently unattainable.

The first invention provides:

a control method for a work vehicle that is applicable to a work vehicle of a structure in which a movement of a bucket hydraulic cylinder is restricted by abutment of a work equipment constituted by a bucket and a boom against a stopper, whereby the bucket in a dump position is forcibly actuated in a tilt direction and the bucket hydraulic cylinder is pressurized by a lifting operation of the boom, wherein control is performed to moderate the pressurization of the bucket hydraulic cylinder or to reduce the pressurization of the bucket hydraulic cylinder to zero when the work equipment is being actuated in an actuation region in which the bucket is forcibly actuated in the tilt direction or in an actuation region close thereto.

The second invention provides the control method for a work vehicle according to the first invention, wherein control is performed to moderate the pressurization of the bucket hydraulic cylinder or to reduce the pressurization of the bucket hydraulic cylinder to zero when the work equipment is being actuated in an actuation region close to an actuation region in which the bucket is forcibly actuated in the tilt direction by lifting the boom in a state in which the bucket is operated to a neutral position or dump operated.

The third invention provides the control method for a work vehicle according to the first invention, wherein control is performed to moderate the pressurization of the bucket hydraulic cylinder or to reduce the pressurization of the bucket hydraulic cylinder to zero when the bucket is being actuated in the tilt direction in an actuation region in which the bucket is forcibly actuated in the tilt direction.

The fourth invention provides the control method for a work vehicle according to the first invention, wherein control is performed to moderate the pressurization of the bucket hydraulic cylinder or to reduce the pressurization of the bucket hydraulic cylinder to zero when the work equipment is being actuated in an actuation region close to an actuation region in which the bucket is forcibly actuated in the tilt direction by operating the boom to a neutral position or lowering the boom in a state in which the bucket is dump operated.

The fifth invention provides the control method for a work vehicle according to the first invention, wherein control is performed to supply a pressure oil to the bucket hydraulic cylinder so as to actuate the bucket hydraulic cylinder in the tilt direction when the work equipment is being actuated in an actuation region close to an actuation region in which the bucket is forcibly actuated in the tilt direction by lifting the boom in a state in which the bucket is operated to a neutral position or dump operated, or when the bucket is being actuated in the tilt direction in an actuation region in which the bucket is forcibly actuated in the tilt direction.

The sixth invention provides the control method for a work vehicle according to the first invention, wherein a pressure oil supplied to the bucket hydraulic cylinder is controlled so as to restrict an actuation speed of the bucket hydraulic cylinder in a dump direction when the work equipment is being actuated in an actuation region close to an actuation region in which the bucket is forcibly actuated in the tilt direction by operating the boom to a neutral position or lowering the boom in a state in which the bucket is dump operated.

The seventh invention provides the control method for a work vehicle according to the fifth invention, wherein control is performed to limit a lifting speed of the boom in combination with control performed to supply the pressure oil to the bucket hydraulic cylinder.

The eighth invention provides:

a control apparatus for a work vehicle of a structure in which a movement of a bucket hydraulic cylinder is restricted by abutment of a work equipment constituted by a bucket and a boom against a stopper, whereby the bucket in a dump position is forcibly actuated in a tilt direction and the bucket hydraulic cylinder is pressurized by a lifting operation of the boom, the control apparatus including:

a bucket control valve that controls a direction and a flow rate of a pressure oil supplied to the bucket hydraulic cylinder;

boom detection means for detecting an angle or a height of the boom;

bucket cylinder stroke detection means for detecting a stroke of the bucket hydraulic cylinder;

boom operation direction detection means for detecting an operation direction of the boom;

bucket operation direction detection means for detecting an operation direction of the bucket;

storage means for storing an actuation region in which the bucket is forcibly actuated in a tilt direction and an actuation region close to this actuation region, in association with a work equipment posture specified by the boom angle or height and the bucket cylinder stroke; and control means for controlling the bucket control valve so as to actuate the bucket hydraulic cylinder in the tilt direction when the work equipment posture specified by the detected boom angle or height and the detected bucket cylinder stroke is within the actuation region in which the bucket is forcibly actuated in the tilt direction or within the actuation region close to this actuation region, as determined with reference to the storage means, and when the detected boom operation direction is a lifting direction and the detected bucket operation direction is a dump direction or the actuation of the bucket is stopped.

The ninth invention provides:

a control apparatus for a work vehicle of a structure in which a movement of a bucket hydraulic cylinder is restricted by abutment of a work equipment constituted by a bucket and a boom against a stopper, whereby the bucket in a dump position is forcibly actuated in a tilt direction and the bucket hydraulic cylinder is pressurized by a lifting operation of the boom, the control apparatus including:

a bucket control valve that controls a direction and a flow rate of a pressure oil supplied to the bucket hydraulic cylinder;

boom detection means for detecting an angle or a height of the boom;

bucket cylinder stroke detection means for detecting a stroke of the bucket hydraulic cylinder;

boom operation direction detection means for detecting an operation direction of the boom;

bucket operation direction detection means for detecting an operation direction of the bucket;

storage means for storing an actuation region in which the bucket is forcibly actuated in a tilt direction and an actuation region close to this actuation region, in association with a work equipment posture specified by the boom angle or height and the bucket cylinder stroke; and control means for controlling the bucket control valve so as to restrict an actuation speed of the bucket hydraulic cylinder in a dump direction when the work equipment posture specified by the detected boom angle or height and the detected bucket cylinder stroke is within the actuation region in which the bucket is forcibly actuated in the tilt direction or within the actuation region close to this actuation region, as determined with reference to the storage means, and when the detected boom operation direction is a lowering direction or the actuation of the boom is stopped and the detected bucket operation direction is the dump direction.

The tenth invention provides the control apparatus for a work vehicle according to the eighth invention, further including a boom control valve that controls a direction and a flow rate of the pressure oil supplied to the boom hydraulic cylinder, wherein the control means controls the boom control valve so as to restrict also a lifting speed of the boom.

The eleventh invention provides:

a control method for a work vehicle that is applicable to a work vehicle of a structure in which a movement of a bucket hydraulic cylinder is restricted by abutment of a work equipment constituted by a bucket and a boom against a stopper, whereby the bucket in a dump position is forcibly actuated in a tilt direction and the bucket hydraulic cylinder is pressurized by a lifting operation of the boom, the control method including:

a first determination step of determining that a boom angle is greater than a predetermined value and a stroke necessary for the bucket hydraulic cylinder to reach a dump stopper end is less than a predetermined value;

a second determination step of determining that a boom operation direction is a lifting direction and a bucket operation direction is a dump direction or the actuation of the bucket is stopped, and also determining that the boom operation direction is a lowering direction or the actuation of the boom is stopped and the bucket operation direction is the dump direction; and a step of performing control to supply a pressure oil to the bucket hydraulic cylinder so as to actuate the bucket hydraulic cylinder in the tilt direction when the boom angle is determined to be greater than the predetermined value and the stroke necessary for the bucket hydraulic cylinder to reach the dump stopper end is determined to be less than the predetermined value as a result of the first determination step, and the boom operation direction is determined to be the lifting direction and the bucket operation direction is determined to be the dump direction or the actuation of the bucket is stopped as a result of the second determination step, and of controlling the pressure oil supplied to the bucket hydraulic cylinder to restrict an actuation speed of the bucket hydraulic cylinder in the dump direction when the boom angle is determined to be greater than the predetermined value and the stroke necessary for the bucket hydraulic cylinder to reach the dump stopper end is determined to be less than the predetermined value as a result of the first determination step, and the boom operation direction is determined to be the lowering direction or the actuation of the boom is stopped and the bucket operation direction is determined to be the dump direction as a result of the second determination step.

In the present description, the "mechanism limit" of work equipment is defined as a limitation placed on the movement of the bucket hydraulic cylinder by the abutment of the work equipment constituted by the bucket and boom against the stopper.

(Effect of the First Invention, Second Invention, Third Invention, Fifth Invention, Seventh Invention, Eighth Invention, and Tenth Invention)

FIG. 3A shows the state of the bucket hydraulic cylinder 6. In this state, the pressure oil is supplied to the bottom chamber 6B of the bucket hydraulic cylinder 6 and the head chamber 6H is opened. Therefore, the state in which the head chamber 6H of the bucket hydraulic cylinder 6 is open is assumed even if the rod 6*a* of the bucket hydraulic cylinder 6 is drawn out by the force lifting the boom 3 due to the mechanism limit. As a result, the pressurization of the head chamber 6H is moderated (the pressure ΔP of the head chamber 6H becomes less than P shown in FIG. 2A).

In particular, by increasing the flow rate of pressure oil supplied to the bottom chamber 6B of the bucket hydraulic cylinder 6 and increasing the flow rate of pressure oil supplied to the bucket hydraulic cylinder 6, the speed at which the bucket hydraulic cylinder 6 is actuated by the supply of pressure oil is made higher than the speed at which the bucket hydraulic cylinder 6 is actuated by the force lifting the boom 3. Therefore, the pressurization of the head chamber 6H by the force lifting the boom 3 can be eliminated (pressure in the head chamber 6H is 0).

The pressurization of the bottom chamber 6B of the bucket hydraulic cylinder 6 can thus be moderated or reduced to zero.

Therefore, even if the bucket operation lever 12 is thereafter operated and the bucket 4 is actuated in the tilt direction, abrupt and large variations in the oil pressure that have been conventionally encountered (FIG. 2B) are not generated and smooth variations such as shown in FIG. 3B are realized (bottom chamber 6B); Pb→P, head chamber 6H; ΔP→0 or 0→0). Therefore, vibrations generated in the bucket hydraulic cylinder 6 can be substantially moderated or completely eliminated. As a result, impacts acting upon the vehicle body 1*a* and the operator can be moderated or completely eliminated.

Further, since the forcible drawing of the rod 6*a* of the bucket hydraulic cylinder 6 by the force lifting the boom 3 can be eliminated or moderated, operability and workability are improved.

In combination with supplying the pressure oil to the bottom chamber 6B of the bucket hydraulic cylinder 6, it is possible to perform the control restricting the flow rate of the pressure oil supplied to the bottom chamber 5B of the boom hydraulic cylinder 5 in order to restrict the lifting speed of the boom 3. The pressurization of the bucket hydraulic cylinder 6 can be further moderated, when the boom 3 is being lifted, by restricting the lifting speed of the boom 3 (seventh invention, tenth invention).

(Effect of the First Invention, Fourth Invention, Sixth Invention, and Ninth Invention)

The flow rate of the pressure oil supplied to the head chamber 6H of the bucket hydraulic cylinder 6 is reduced and the actuation speed of the bucket hydraulic cylinder 6 in the dump direction is restricted. As a result, the pressurization inside the head chamber 6H of the bucket hydraulic cylinder 6 is moderated. Therefore, even if the bucket operation lever 12 is thereafter operated and the bucket 4 is actuated in the tilt direction, abrupt and large variations in the oil pressure that have been conventionally encountered (FIG. 2B) are not generated and smooth variations are realized, and consequently vibrations generated in the bucket hydraulic cylinder 6 can be substantially moderated or completely eliminated.

(Effect of the Eleventh Invention)

In the eleventh invention, the methods of the fifth invention and sixth invention are implemented. Therefore, vibrations generated in the bucket hydraulic cylinder 6 can be substantially moderated or completely eliminated regardless of the type of operation that is to be performed in the vicinity of the stopper end of the bucket hydraulic cylinder 6.

BRIEF DESCRIPTION OF THE DRAWINGS

FIGS. 10A, 10B, and 10C illustrate the contents of data tables stored in the storage means of the controller.

EXPLANATION OF REFERENCE NUMERALS

1—wheel loader (work vehicle)
2—work equipment
3—boom
4—bucket
5—boom hydraulic cylinder
6—bucket hydraulic cylinder
9—boom angle sensor
10—bell crank angle sensor
11*a*—boom operation direction detection means
12*a*—bucket operation direction detection means
15—boom control valve
16—bucket control valve
20—controller
20M—storage means

BEST MODE FOR CARRYING OUT THE INVENTION

A control method and a control apparatus for a work vehicle in accordance with the present invention will be described below with reference to the appended drawings.

Figure 1:
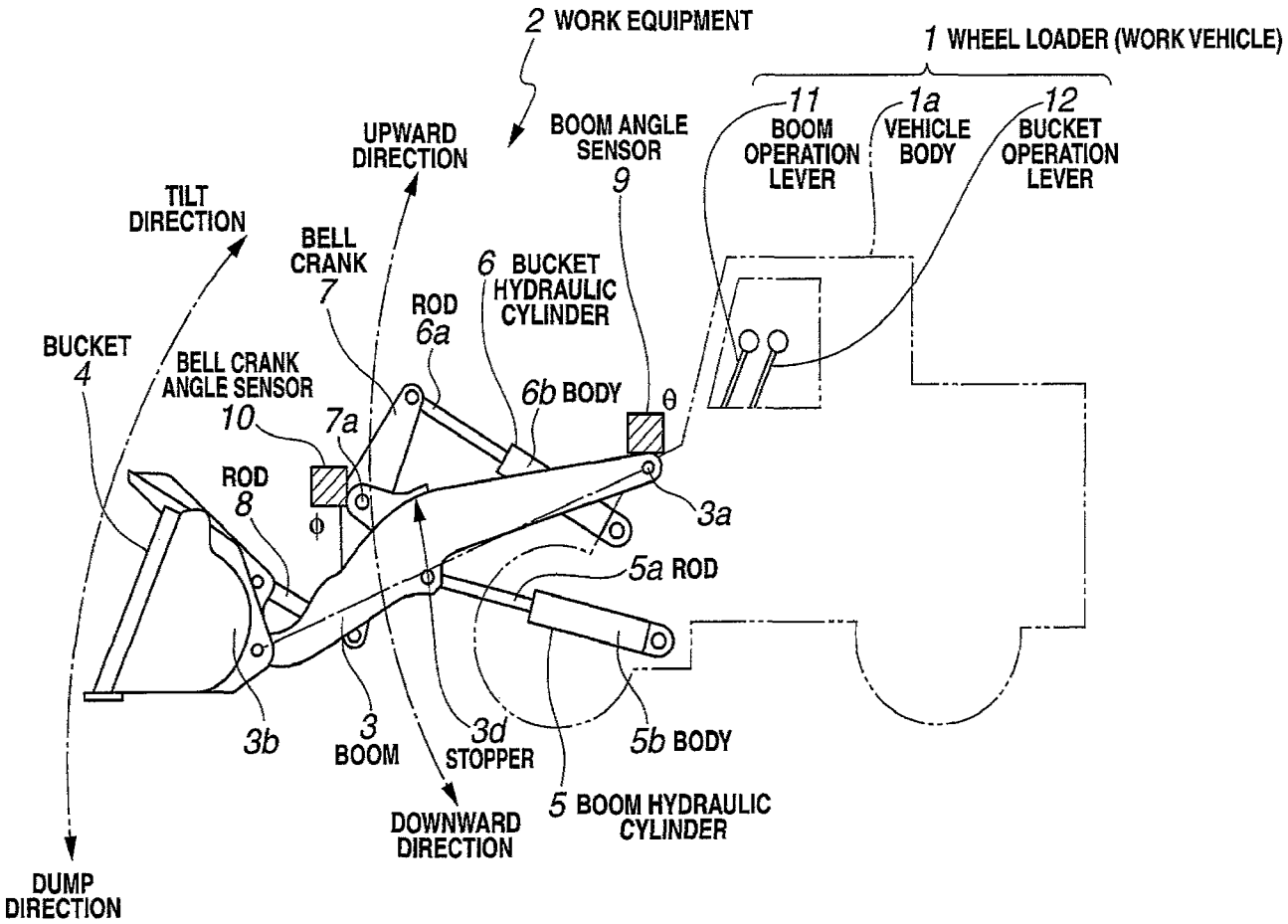
FIG. 1 shows the structure of the work equipment provided in the front portion of the vehicle body of the wheel loader.

FIG. 1 shows the structure of a work equipment 2 provided at a front end of a vehicle body 1*a* of a wheel loader 1.

As shown in FIG. 1, the work equipment 2 is constituted by a boom 3 and a bucket 4. The boom 3 is rotatably attached to the vehicle body 1*a* so that the boom can rotate upward and downward about a rotating shaft 3*a*, and the bucket 4 is attached to the distal end of the boom 3 so as to be rotatable in the dump direction and tilt direction about a rotating shaft 3*b*.

A rod 5*a* of a boom hydraulic cylinder 5 is attached to the boom 3, and a body 5*b* of the boom hydraulic cylinder 5 is attached to the vehicle body 1*a*. Where the rod 5*a* of the boom hydraulic cylinder 5 extends, the boom 3 is actuated upward, and where the rod 5*a* of the boom hydraulic cylinder 5 contracts, the boom 3 is actuated downward.

A bell crank 7 is swingably attached to the boom 3. A rod 6*a* of a bucket hydraulic cylinder 6 is attached to one side, in the longitudinal direction, of the bell crank 7. A body 6*b* of the bucket hydraulic cylinder 6 is attached to the vehicle body 1*a*. One end of a rod 8 is attached to the other side, in the longitudinal direction, of the bell crank 7, and the other end of the rod 8 is attached to the bucket 4. Where the rod 6*a* of the bucket hydraulic cylinder 6 extends, the bucket 4 is actuated in the tilt direction, and where the rod 6*a* of the bucket hydraulic cylinder 6 is contracted, the bucket 4 is actuated in the dump direction.

A boom angle sensor 9 that detects the rotation angle θ (referred to hereinbelow as "boom angle θ") of the boom 3 is provided at the rotating shaft 3*a* at the base of the boom 3.

Here, the horizontal posture of the boom 3, that is, the posture in which a line connecting the boom rotating shaft 3*a*, 3*b* is parallel to the horizontal line, will be assumed to correspond to a zero value (θ=0) of the boom angle θ, the direction in which the boom 3 rises with respect to the horizontal boom posture is taken for positive values and the direction in which the boom 3 lowers with respect to the horizontal boom posture is taken for negative values.

The bucket 4 rotates following the swinging of the bell crank 7, and a bell crank angle sensor 10 that detects a swinging angle ϕ (referred to hereinbelow as "bell crank angle ϕ") of the bell crank 7 is provided at a swinging shaft 7*a* of the bell crank 7.

The stroke L (referred to hereinbelow as "bucket cylinder stroke L") of the bucket hydraulic cylinder 6 can be uniquely calculated on the basis of known data relating to the boom angle θ, bell crank ϕ, and a link mechanism including the bell crank 7 and the rod 8. It is also possible to detect the height of the boom 3, instead of the boom angle, and calculate the bucket cylinder stroke L on the basis of the boom height. The bucket cylinder stroke L is defined so that the stroke value during maximum retraction is 0 and increases with the extension toward the tilting side.

A sensor that directly detects the bucket cylinder stroke L may be also provided.

The boom 3 can be actuated by operating a boom operation lever 11 provided in the control cabin.

The bucket 4 can be actuated by operating a bucket operation lever 12 provided in the control cabin.

Figure 4:
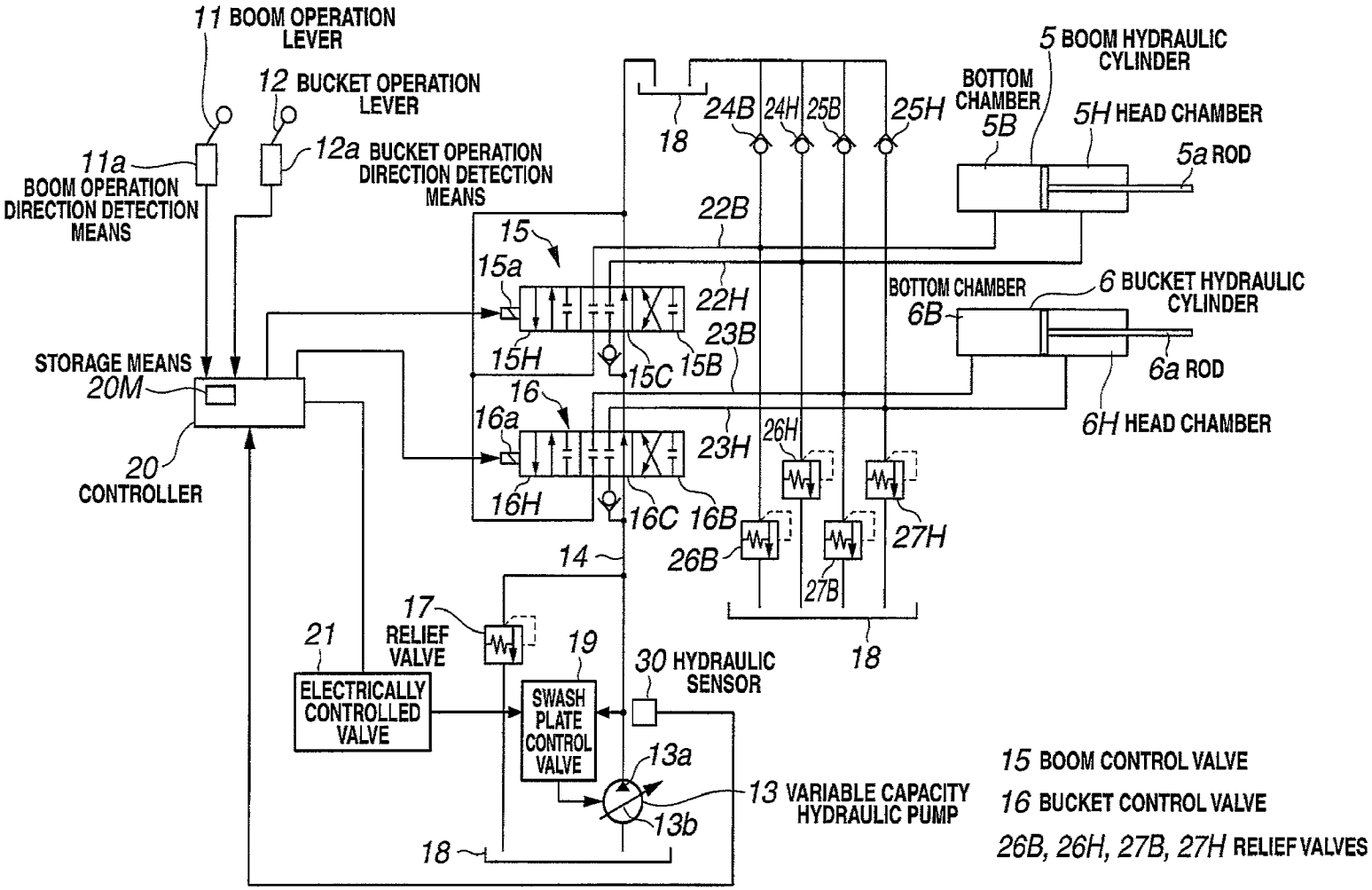
FIG. 4 shows a hydraulic circuit of a series circuit configuration that is installed on a wheel loader.
Figure 5:
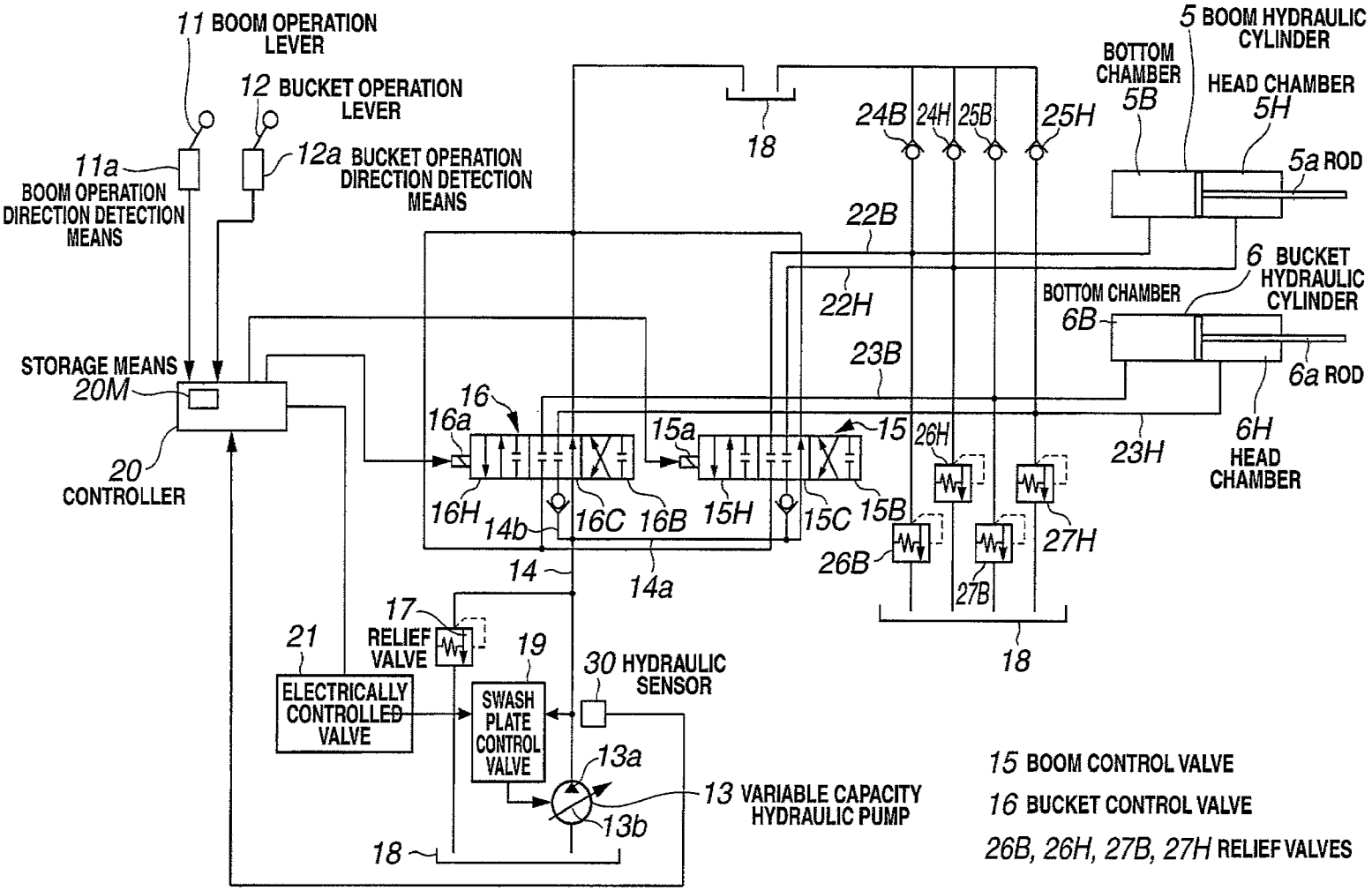
FIG. 5 shows a hydraulic circuit of a parallel circuit configuration that is installed on a wheel loader.

FIG. 4 and FIG. 5 show hydraulic circuits installed on the wheel loader 1. Either of the hydraulic circuits shown in FIG. 4 and FIG. 5 is installed on the wheel loader 1.

FIG. 4 shows a series circuit configuration in which a boom control valve 15 and a bucket control valve 16 are disposed in series with a pump discharge oil channel 14. FIG. 5 shows a parallel circuit configuration in which the boom control valve 15 and the bucket control valve 16 are provided in parallel to the pump discharge oil channels 14*a*, 14*b*, respectively.

As shown in FIG. 4, the hydraulic pump 13 is of a variable capacity type, and the discharge port 13*a* thereof communicates with the pump discharge oil channel 14. The hydraulic pump 13 is driven by an engine (not shown in the figure), sucks in the working oil from a tank 18, and discharges the pressure oil into the pump discharge oil channel 14. A swash plate 13*b* of the hydraulic pump 13 is driven by a swash plate control valve 19. The controller 20 outputs a swash plate control command as an electric signal to an electrically controlled valve 21. The electrically controlled valve 21 converts the electric signal into a hydraulic signal and outputs the hydraulic signal to the swash plate control valve 19.

In the pump discharge oil channel 14, the side where the hydraulic pump 13 is located is taken to be the upstream side, the bucket control valve 16 is provided on the upstream side, and the boom control valve 15 is provided on the downstream side.

A relief valve 17 is connected to the pump discharge oil channel 14 between the bucket control valve 16 and the hydraulic pump 13. The relief valve 17 relieves the pressure oil to the tank 18 when a pressure inside the pump discharge oil channel 14 between the bucket control valve 16 and the hydraulic pump 13 reaches the predetermined relief pressure.

The boom control valve 15 and the bucket control valve 16 are flow rate and direction control valves. The boom control valve 15 controls the direction and flow rate of the pressure oil supplied to the boom hydraulic cylinder 5. The bucket control valve 16 controls the direction and flow rate of the pressure oil supplied to the bucket hydraulic cylinder 6.

The boom control valve 15 and the bucket control valve 16 are electromagnetic proportional control valves.

The boom control valve 15 is actuated when a boom actuation command signal as an electric signal outputted from the controller 20 is applied to the electromagnetic solenoid 15*a* of the boom control valve 15.

The boom operation lever 11 is provided with the boom operation direction detection means 11*a*. The boom operation direction detection means 11*a* detects the operation direction, that is, "LIFTING OPERATION", "NEUTRAL", and "LOWERING OPERATION" and also the operation amount of the boom operation lever 11, and outputs the detected parameters as boom operation signals to the controller 20. In the controller 20, a boom actuation command signal for obtaining the valve position corresponding to the boom operation signal is outputted to the boom control valve 15. The boom control valve 15 is actuated in response to the boom actuation command signal.

When the contents of the boom operation signal are the "LIFTING OPERATION", the valve position of the boom control valve 15 is switched to a bottom position 15B. In this case, the pressure oil passes through the opening with an opening surface area corresponding to the valve position, the pressure oil with a flow rate corresponding to the opening surface area is supplied to a bottom chamber 5B of the boom hydraulic cylinder 5 via the oil channel 22B, and the pressure oil located in the head chamber 5H of the boom hydraulic cylinder 5 is discharged to the tank 18 via an oil channel 22H and the boom control valve 15. As a result, the rod 5*a* of the boom hydraulic cylinder 5 extends and the boom 3 is actuated in the lifting direction.

Further, when the contents of the boom operation signal are the "LOWERING OPERATION", the valve position of the boom control valve 15 is switched to a head position 15H. In this case, the pressure oil passes through the opening with an opening surface area corresponding to the valve position, the pressure oil with a flow rate corresponding to the opening surface area is supplied to the head chamber 5H of the boom hydraulic cylinder 5 via the oil channel 22H, and the pressure oil located in the bottom chamber 5B of the boom hydraulic cylinder 5 is discharged to the tank 18 via an oil channel 22B the boom control valve 15. As a result, the rod 5*a* of the boom hydraulic cylinder 5 is contracted and the boom 3 is actuated in the lowering direction.

Further, when the contents of the boom operation signal are the "NEUTRAL", the valve position of the boom control valve 15 is switched to a neutral position 15C. In this case, the opening is closed, and the supply of the pressure oil to the boom hydraulic cylinder 5 and the discharge of the pressure oil from the boom hydraulic cylinder 5 are shut down. As a result, the actuation of the rod 5*a* of the boom hydraulic cylinder 5 is stopped and the actuation of the boom 3 is stopped.

Meanwhile, the bucket control valve 16 is actuated when a bucket actuation command signal as an electric signal outputted from the controller 20 is applied to the electromagnetic solenoid 16*a* of the bucket control valve 16.

The bucket operation lever 12 is provided with bucket operation direction detection means 12*a*. The bucket operation direction detection means 12*a* detects the operation direction, that is, "TILTING OPERATION", "NEUTRAL", and "DUMPING OPERATION" and also the operation amount of the bucket operation lever 12, and outputs the detected parameters as bucket operation signals to the controller 20. In the controller 20, a bucket actuation command signal for obtaining the valve position corresponding to the bucket operation signal is outputted to the bucket control valve 16. The bucket control valve 16 is actuated in response to the bucket actuation command signal.

When the contents of the bucket operation signal are the "TILTING OPERATION", the valve position of the bucket control valve 16 is switched to a bottom position 16B. In this case, the pressure oil passes through the opening with an opening surface area corresponding to the valve position, the pressure oil with a flow rate corresponding to the opening surface area is supplied to a bottom chamber 6B of the bucket hydraulic cylinder 6 via the oil channel 23B, and the pressure oil located in the head chamber 6H of the bucket hydraulic cylinder 6 is discharged to the tank 18 via an oil channel 23H and the bucket control valve 16. As a result, the rod 6*a* of the bucket hydraulic cylinder 6 extends and the bucket 4 is actuated in the tilt direction.

Further, when the contents of the bucket operation signal are the "DUMPING OPERATION", the valve position of the bucket control valve 16 is switched to a head position 16H. In this case, the pressure oil passes through the opening with an opening surface area corresponding to the valve position, the pressure oil with a flow rate corresponding to the opening surface area is supplied to the head chamber 6H of the bucket hydraulic cylinder 6 via the oil channel 23H, and the pressure oil located in the bottom chamber 6B of the bucket hydraulic cylinder 6 is discharged to the tank 18 via an oil channel 23B and the bucket control valve 16. As a result, the rod 6*a* of the bucket hydraulic cylinder 6 is contracted and the bucket 4 is actuated in the dump direction.

Further, when the contents of the bucket operation signal are the "NEUTRAL", the valve position of the bucket control valve 16 is switched to a neutral position 16C. In this case, the opening is closed, and the supply of the pressure oil to the bucket hydraulic cylinder 6 and the discharge of the pressure oil from the bucket hydraulic cylinder 6 are shut down. As a result, the actuation of the rod 6*a* of the bucket hydraulic cylinder 6 is stopped and the actuation of the bucket 4 is stopped.

Suction valves 24B, 24H, 25B, 25H constituted by check valves are connected to the oil channels 22B, 22H, 23B, 23H, respectively. The suction valves 24B, 24H, 25B, 25H allow the flow of the pressure oil only in the direction from the tank 18 to the bottom chamber 5B, in the direction from the tank 18 to the head 5H chamber, in the direction from the tank 18 to the bottom chamber 6B, and in the direction from the tank 18 to the head chamber 6H, respectively, thereby acting to suck in the pressure oil from the tank 18 and supply the pressure oil to the bottom chamber 5B, head 5H, bottom chamber 6B, and head chamber 6H when the bottom chamber 5B, head 5H, bottom chamber 6B, and head chamber 6H are under respective negative pressures.

Relief valves 26B, 26H, 27B, 27H are connected to the oil channels 22B, 22H, 23B, 23H, respectively. The relief valves 26B, 26H, 27B, 27H discharge the pressure oil to the tank 18 when the pressure oil in the bottom chamber 5B, head 5H, bottom chamber 6B, and head chamber 6H, respectively, reaches a relief pressure.

The signal indicating the boom angle θ detected by the boom angle sensor 9 and the signal indicating the bell crank angle ϕ detected by the bell crank angle sensor 10 are inputted to the controller 20. In the controller 20, the bucket cylinder stroke L is calculated on the basis of the boom angle θ and the bell crank angle ϕ.

The explanation above is conducted with reference to FIG. 4, but the parallel circuit configuration shown in FIG. 5 is identical to the series circuit configuration shown in FIG. 4, except that the pump discharge oil channel 14 is branched into pump discharge flow channels 14*a*, 14*b*, and the boom control valve 15 and the bucket control valve 16 are provided in the discharge flow channels 14*a*, 14*b*, respectively. Accordingly, the redundant explanation is herein omitted.

In the series circuit configuration shown in FIG. 4, the bucket control valve 16 is disposed on the upstream side, as viewed from the hydraulic pump 13, and a bucket preferential circuit is realized. Therefore, where the full bucket operation is performed, the discharged oil is unlikely to flow to the boom control valve 15 on the downstream side and the actuation of the boom 3 is inhibited.

By contrast, in the parallel circuit configuration shown in FIG. 5, where the two control valves 15, 16 are similarly actuated, the discharge oil easily flows to the control valve with a lower load. The wheel loader 1 is typically required to operate in a bucket preferential mode. Therefore, when the boom operation is performed simultaneously with the bucket operation, the operation corresponding to the series circuit can be performed by outputting from the controller 20 a boom actuation command signal that inhibits the actuation of the boom control valve 15.

The hardware configuration shown in FIG. 4 and FIG. 5 is provided on the existing wheel loader 1. The control method in accordance with the present invention that is performed with the controller 20 is described below. The present invention can be easily implemented by adding and modifying, as appropriate, a program that is installed in the controller 20 or data to be stored therein, without adding a constituent element to the existing hardware configuration or modifying the constituent elements thereof.

Figure 6:
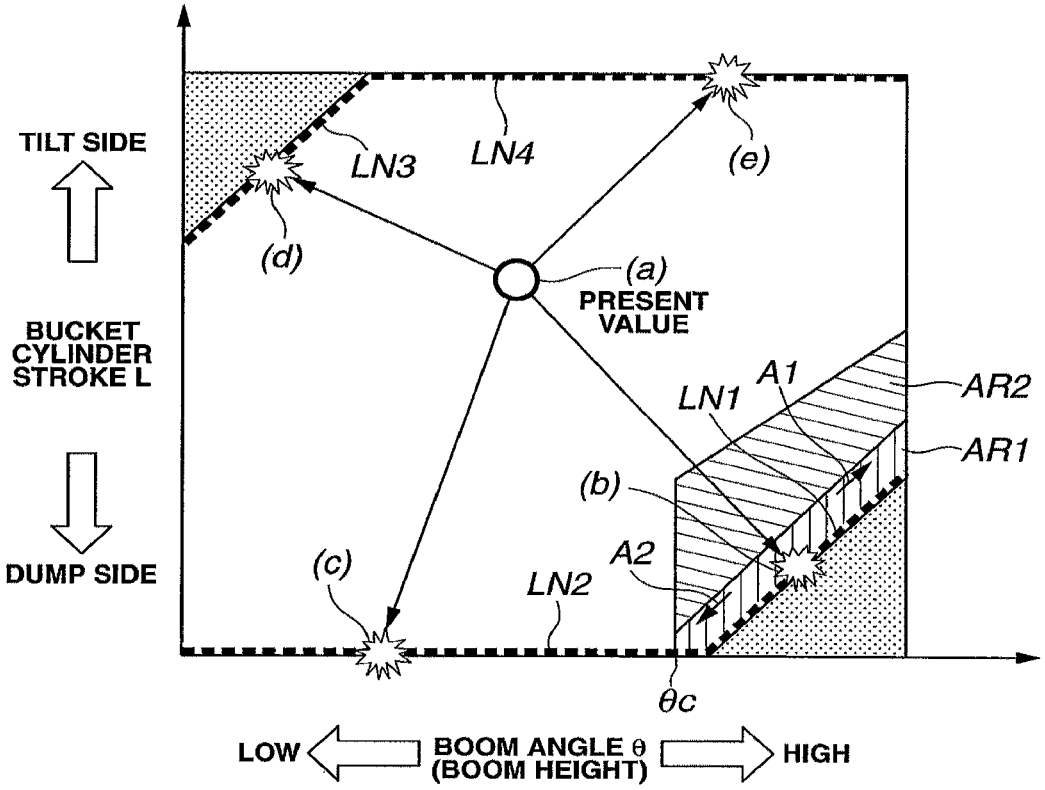
FIG. 6 illustrates the contents stored in the storage means of the controller 20.

FIG. 6 shows the contents stored in storage means 20M of the controller 20. In the storage means 20M, an actuation region AR1 in which the bucket 4 is forcibly actuated in the tilt direction and a region AR2 located in the vicinity to the actuation region AR1 are stored in association with the work equipment posture specified by the boom angle θ and bucket cylinder stroke L. FIG. 6 will be explained below in association with FIGS. 7A, 7B, 7C, 7D and 7E.

In FIG. 6, the boom angle θ is plotted against the abscissa. The leftward direction in the figure is the lowering direction of the boom 3, and the rightward direction in the figure is the lifting direction of the boom 3. The work equipment posture on the left side in the figure features a low boom 3, and the work equipment posture on the right side of the figure features a high boom 3.

In FIG. 6, the bucket cylinder stroke L is plotted against the ordinate. The upward direction in the figure is the direction in which the bucket 4 is actuated to the tilt side, and the downward direction in the figure is the direction in which the bucket 4 is actuated to the dump side.

FIGS. 7A, 7B, 7C, 7D, and 7E illustrate respective postures of the work equipment 2.

The work equipment postures shown in FIGS. 7A, 7B, 7C, 7D, and 7E correspond to the machine postures in point (a), point (b), point (c), point (d), and point (e), respectively, in FIG. 6. For example, where the present posture of the work equipment 2 is the posture in point (a), the work equipment postures in point (b), point (c), point (d), and point (e) are obtained by actuating the boom 3 and the bucket 4 in the directions shown by respective arrows.

Lines LN1, LN2, LN3, LN4 shown in FIG. 6 are "a line along which the bucket 4 is forcibly actuated in the tilt direction by the boom lifting operation", "a line along which the bucket 4 moves to the stroke end in the dump direction", "a line along which the bucket 4 is forcibly actuated in the dump direction by the boom lowering operation", "a line along which the bucket 4 moves to the stroke end in the tilt direction".

The "stroke end" as referred to herein corresponds to the most retracted position of the rod 6*a* or the most extended position of the rod 6*a* of the bucket hydraulic cylinder 6, and the "mechanism limit" is a position in which the movement of the rod 6*a* of the bucket hydraulic cylinder 6 is restricted when the work equipment 2 abuts against the stoppers 3*c*, 3*d*. The stroke end is not reached when the mechanism limit is realized.

Figure 7A:
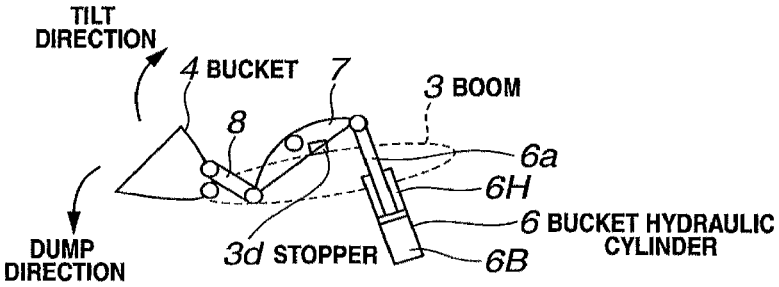
FIGS. 7A, 7B, 7C, 7D, and 7E illustrate postures of the work equipment.
Figure 7B:
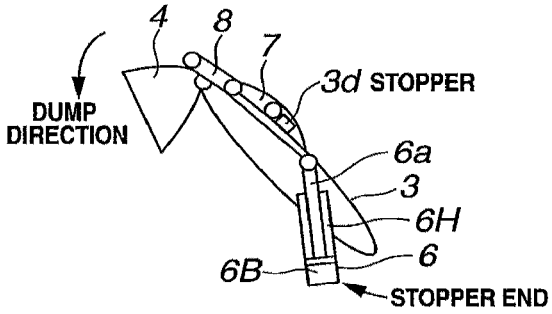

FIG. 7B (point (b) in FIG. 6) shows by way of example a work equipment posture in which the "mechanism limit" is reached when the boom 3 is at a high position and the bucket 3 is in the dump position. The work equipment posture (b) is on the line LN1.

Where the boom 3 is further lifted from the state with the work equipment posture (b), the bucket 4 is forcibly actuated in the tilt direction along the line LN1. The movement in this case is shown by arrow A1 in FIG. 6.

The bucket cylinder stroke L at which the work equipment posture on the line LN1 is assumed is called a "stopper end Lc". The value of the stopper end Lc moves to the tilt side and increases with the increase in the boom angle θ.

Figure 7C:
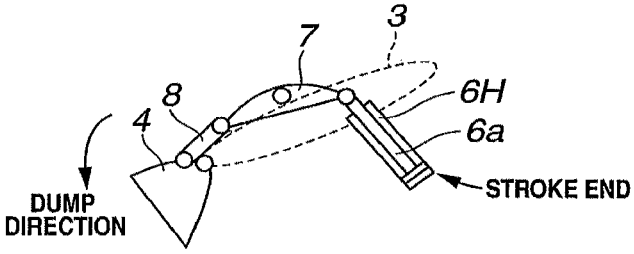

FIG. 7C (point (c) in FIG. 6) shows by way of example a work equipment posture in which the boom 3 is at a low position and the bucket 3 reached the stroke end in the dump direction. The work equipment posture (c) is on the line LN2.

Figure 7D:
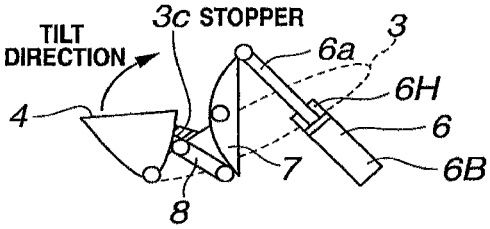

FIG. 7D (point (d) in FIG. 6) shows by way of example a work equipment posture in which the "mechanism limit" is reached when the boom 3 is at a low position and the bucket 3 is in the tilt state. The work equipment posture (d) is on the line LN3. Where the bucket 3 is actuated toward the tilt side when the boom 3 is at a low position, the bucket 4 abuts against the stopper 3*c* prior to reaching the stroke end (see FIG. 7D).

Figure 7E:
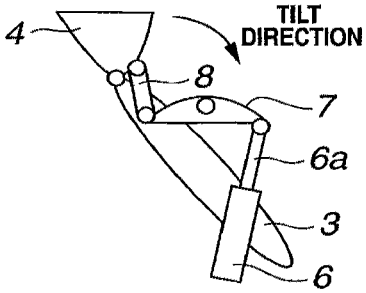

FIG. 7E (point (e) in FIG. 6) shows by way of example a work equipment posture in which the boom 3 is at a high position and the bucket 3 has reached the stroke end in the tilt direction. The work equipment posture (e) is on the line LN4. Where the bucket 3 is actuated toward the tilt side when the boom angle θ is equal to or higher than a predetermined value and the boom 3 is at a high position, the bucket 3 reaches the stroke end, without abutting against the stopper 3*c* (see FIG. 7E).

The above-mentioned lines LN1, LN2, LN3, LN4 represent the work equipment postures after the "mechanism limit" or "stroke end" has been reached. When the work equipment postures are at the lines LN1, LN2, LN3, LN4, the hydraulic pressure of the bottom chamber 6B or head chamber 6H of the bucket hydraulic cylinder 6 reaches the set relief pressure of the relieve valves 27B, 27H. Therefore, where the boom angle θ at the point of time in which the work equipment 2 is actuated and the set relief pressure of the relieve valves 27B, 27H is reached and the bucket cylinder stroke L are measured, the lines LN1, LN2, LN3, LN4 can be determined. Further, when the work equipment postures are at the lines LN1, LN2, LN3, LN4, the discharge pressure of the hydraulic pump 13 reaches the set relief pressure of the relief valve 17. Therefore, where the boom angle θ at the point of time in which the work equipment 2 is actuated and the set relief pressure of the relieve valve 17 is reached and the bucket cylinder stroke L are measured, the lines LN1, LN2, LN3, LN4 can be similarly determined. For example, it is possible to determine whether the relief valve 17 has reached the set relief pressure by providing, as shown in FIG. 4 and FIG. 5, a hydraulic sensor 30 that detects the hydraulic pressure inside the pump discharge oil channel 14, and fetching the detection value of the hydraulic sensor 30 to the controller 20.

Figures 8, 9A, 9B, 9C:
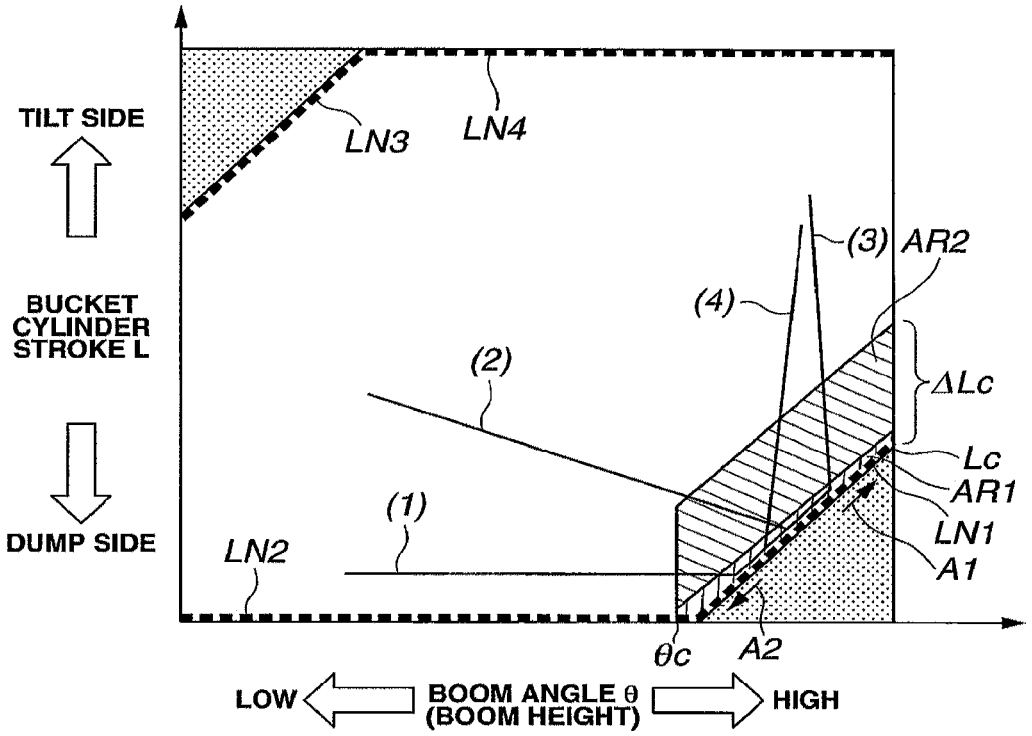
FIG. 8 corresponds to FIG. 6 and shows a region in which the control is performed in the embodiment.
FIGS. 9A, 9B, and 9C illustrate the contents of data tables stored in the storage means of the controller.

FIG. 8 corresponds to FIG. 6 and shows a region in which the control of the present embodiment is performed.

AR1 in FIG. 8 is an "actuation region in which the bucket 4 is forcibly actuated in the tilt direction" and AR2 is a "region in the vicinity of the actuation region AR1".

The "actuation region AR1 in which the bucket 4 is forcibly actuated in the tilt direction" corresponds to the "line LN1 along which the bucket 4 is forcibly actuated in the tilt direction by the boom lifting operation". The term "region" is used herein to take into account also the case in which the actuation is actually performed along the line somewhat separated from the line LN1, rather than along the line LN1" when the control of the present embodiment is performed. This is because the phenomenon can occur in which the mechanism limit is not reached when the actuation speed of the bucket 4 in the tilt direction is higher than the lifting speed of the boom 3.

The "region AR2 in the vicinity of the actuation region AR1" is a region in which the boom 3 is high and the boom angle θ exceeds a predetermine angle Δc (for example 18 degrees) and the stroke ΔL necessary to reach the stopper end Lc (bucket cylinder stroke L corresponding to the line LN1) is less than a predetermined value ΔLc (for example, 50 mm).

In this case, the following control is performed in the controller 20.

(First Control)

The control is performed to supply the pressure oil to the bucket hydraulic cylinder 6 so as to actuate the bucket hydraulic cylinder 6 in the tilt direction when the bucket 4 is being actuated in the tilt direction A1 in the vicinity of the actuation region AR1 in which the bucket 4 is forcibly actuated in the tilt direction (when in the region AR2) or in the actuation region AR1 in which the bucket 4 is forcibly actuated in the tilt direction, by lifting the boom 3 in a state in which the bucket 4 is operated to a neutral position or dump operated.

(Second Control)

The pressure oil supplied to the bucket hydraulic cylinder 6 is controlled so as to restrict an actuation speed of the bucket hydraulic cylinder 6 in the dump direction in the vicinity of the actuation region AR1 in which the bucket 4 is forcibly actuated in the tilt direction (when in the region AR2) by stopping the boom 3 at a neutral position or lowering the boom in a state in which the bucket 4 is dump operated.

FIGS. 9A, 9B and 9C show examples of control parameters and FIGS. 10A, 10B and 10C show another example of control parameters.

FIGS. 9A, 9B and 9C show the control parameters that have been experimentally obtained with the object of avoiding entirely the impacts acting upon the vehicle body 1*a* and the operator.

FIG. 9A shows the contents of a data table that stores the correspondence relationship between the boom angle θ (deg) and the bucket cylinder stroke L (mm) realized when the bucket hydraulic cylinder 6 has reached the dump stroke end (line LN2) and the dump stopper end (line LN1) of the bucket hydraulic cylinder 6.

FIG. 9B shows the control parameters for performing the first control. This figure shows the contents of a data table that stores the correspondence relationship between the stroke ΔL (mm) necessary to reach the dump stopper end Lc (bucket cylinder stroke L corresponding to the line LN1) and the target flow rate Qt (%; referred to hereinbelow as bucket tilt target flow rate) of the pressure oil supplied to the bottom chamber 6B of the bucket hydraulic cylinder 6. The bucket tilt target flow rate Qt (%) is a value obtained when the flow rate attained as the bucket control valve 16 is switched to the tilt side (bottom position 16B) and actuated to a fully open state (maximum surface area of the opening) is taken as 100%. In a region in which the necessary stroke ΔL is equal to or greater than the predetermined value ΔLc (50 mm), the bucket tilt target flow rate Qt (%) is 0, but in the region in which the necessary stroke ΔL is less than the predetermined value ΔLc (50 mm), the bucket tilt target flow rate Qt (%) is set to increase gradually as the stopper end Lc is approached. Essentially, the bucket 4 should be dumped or set to neutral and a tilting command is not issued. In other words, the bucket tilt target flow rate Qt (%) should be 0%. However, the bucket tilt target flow rate Qt (%) is increased to avoid forcibly tilting the bucket 4 when in the actuation region AR2.

The controller 20 issues a bucket actuation command signal necessary to obtain the bucket tilt target flow rate Qt (%) to the bucket control valve 16.

FIG. 9C shows control parameters for performing the second control. This figure shows the contents of a data table that stores the correspondence relationship between the stroke ΔL (mm) necessary to reach the dump stopper end Lc (bucket cylinder stroke L corresponding to the line LN1) and the target flow rate Qd (%; referred to hereinbelow as bucket dump target flow rate) of the pressure oil supplied to the head chamber 6H of the bucket hydraulic cylinder 6. The bucket dump target flow rate Qd (%) is a value obtained when the flow rate corresponding to the operation amount of the bucket operation direction detection means 12*a* is taken as 100%. In a region in which the necessary stroke ΔL is equal to or greater than the predetermined value ΔLc (50 mm), the bucket dump target flow rate Qd (%) is 100%, but in the region in which the necessary stroke ΔL is less than the predetermined value ΔLc (50 mm), the bucket dump target flow rate Qd (%) is set to decrease gradually as the stopper end Lc is approached. Essentially, the flow rate corresponding to the operation amount of the bucket operation lever 12 in the dump direction is supplied to the head chamber 6H of the bucket hydraulic cylinder 6. However, when in the actuation region AR2, it is necessary to reduce the flow rate supplied to the head chamber 6H in order to suppress the actuation of the bucket 4 in the dump direction. Therefore, the bucket dump target flow rate Qd (%) is gradually decreased.

The controller 20 outputs a bucket actuation command signal necessary to obtain a target flow rate of the bucket dump target flow rate Qd (%) corresponding to the operation amount of the bucket operation direction detection means 12*a* to the bucket control valve 16.

FIGS. 10A, 10B, and 10C show the control parameters that have been experimentally obtained with the object of enabling the functional moderation of impacts acting upon the vehicle body 1*a* and the operator in comparison with the conventional configurations, even if the impacts cannot be completely eliminated.

FIGS. 10A, 10B, and 10C show the contents of data tables corresponding to FIGS. 9A, 9B, and 9C, respectively. The correspondence relationships are similar to those shown in FIGS. 9A, 9B, and 9C and the redundant explanation thereof is therefore omitted. However, the threshold value ΔLc of the necessary stroke ΔL is set to a value (30 mm) lower than the value shown in FIGS. 9B and 9C. Further, the comparison of B with FIG. 9B shows that the bucket tilt target flow rate Qt (%) is smaller in the case shown in FIG. 10B, provided that the necessary stroke ΔL is the same. The comparison of FIG. 10C with FIG. 9C shows that the bucket dump target flow rate Qd (%) is larger in the case shown in FIG. 10C, provided that the necessary stroke ΔL is the same.

Figure 11:
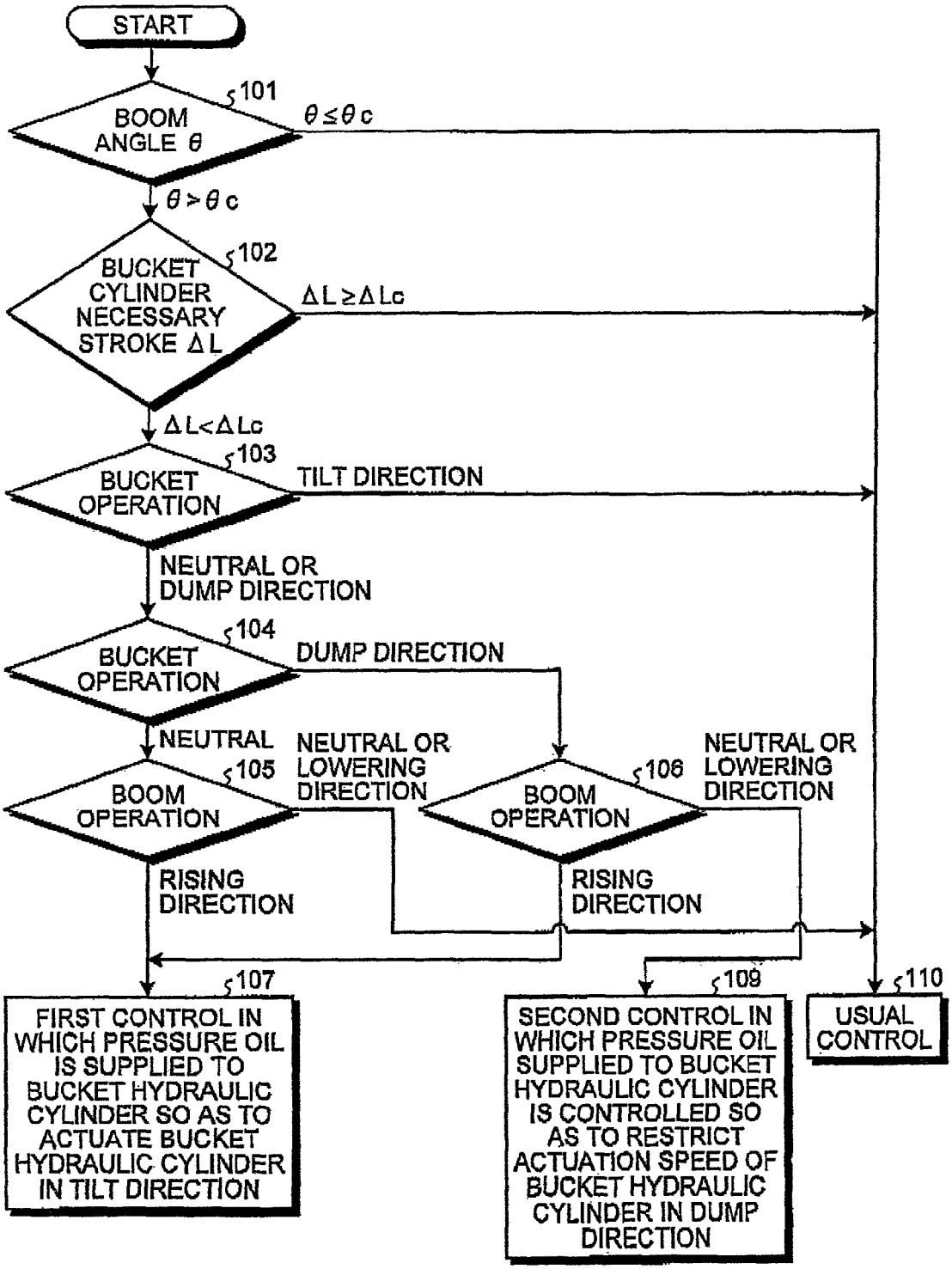
FIG. 11 is a flowchart showing the processing procedure of the control performed by the controller.

FIG. 11 is a flowchart showing the processing sequence of the control performed by the controller 20.

Where the processing is started, in steps 101, 102, it is determined, with reference to the storage means 20M, whether the work equipment posture specified by the detected boom angle θ and the detected bucket cylinder stroke L is in the region AR2 or region AR1.

Thus, when it is determined that the detected boom angle θ is equal to or less than the predetermined angle θc (the determination θ≤Θc in step 101) or when it is determined that the necessary stroke ΔL is equal to or greater than the predetermined value ΔLc (50 mm) (the determination ΔL ΔLc in step 102), the present work equipment posture is not in the range of the region AR2 or region AR1 and the first control and the second control are not necessary. Accordingly, a bucket actuation command signal corresponding to the present operation of the bucket operation lever 12 is outputted to the bucket control valve 16, or when the control other than the control of the present embodiments is performed, the bucket actuation command signal corresponding to the other control is outputted to the bucket control valve 16 (step 110; referred to hereinbelow as the normal control).

By contrast, when it is determined that the detected boom angle θ is greater than the predetermined angle θc (the determination θ>θc in step 101) and when it is determined that the necessary stroke ΔL is less than the predetermined value ΔLc (50 mm) (the determination ΔL<ΔLc in step 102), it is assumed that the present work equipment posture is in the range of the region AR2 or region AR1, and that the first control or the second control is required to be performed, and a transition is made to the following step 103.

In steps 103, 104, 105, 106, it is determined whether or not "the detected boom operation direction is a lifting direction and the detected bucket operation direction is a dump direction or the actuation of the bucket is stopped" (condition of the first control) or "the detected boom operation direction is a lowering direction or the actuation of the boom is stopped and the detected bucket operation direction is a dump direction" (condition of the second control) (normal control).

Thus, when it is determined that the bucket operation direction detected by the bucket operation direction detection means 12*a* is a tilt direction ("tilt direction" determination in step 103), the bucket control valve 16 is actuated by the operator's operation so that the pressure oil flows out of the head chamber 6H of the bucket hydraulic cylinder 6. Therefore, it is determined that the head chamber 6H of the bucket hydraulic cylinder 6 cannot be pressurized, a transition is made to step 110, and the normal control is performed (step 110).

When it is determined that the bucket operation direction detected by the bucket operation direction detection means 12*a* is neutral or a dump direction ("neutral or dump direction" determination in step 103), it is then determined whether the bucket operation direction detected by the bucket operation direction detection means 12*a* is neutral or the bucket operation direction is a dump direction (step 104).

When it is determined that the bucket operation direction is neutral ("neutral" determination in step 104), it is then determined whether the boom operation direction detected by the boom operation direction determination means 11*a* is a lifting direction or the boom operation direction is neutral or a lowering direction (step 105). When it is thus determined that the boom operation direction is a lifting direction ("lifting direction" determination in step 105), the first control is performed in such a manner that a bucket actuation command signal is generated with reference to the data table shown in FIG. 9B or FIG. 10B, the generated bucket actuation command signal is outputted to the bucket control valve 16, and the bucket control valve 16 is controlled. Thus, when the detected boom operation direction is a lifting direction and the detected bucket operation direction is neutral, the bucket control valve 16 is controlled so that the bucket hydraulic cylinder 6 is actuated in the tilt direction (step 107).

When it is determined in step 105 that the boom operation direction is neutral or a lowering direction ("neutral or a lowering direction" determination in step 105), the bucket operation lever 12 is neutral and the mutual arrangement of the bell crank 7 and boom 3 is such that the two are stopped or move in the direction of mutual separation. Therefore, it is determined that the head chamber 6H of the bucket hydraulic cylinder 6 cannot be pressurized, a transition is made to step 110, and the normal control is performed (step 110).

When it is determined in step 104 that the bucket operation direction is a dump direction ("dump direction" determination in step 104), it is then determined whether the boom operation direction detected by the boom operation direction determination means 11*a* is a lifting direction or the boom operation direction is neutral or a lowering direction (step 106). When it is thus determined that the boom operation direction is a lifting direction ("lifting direction" determination in step 106), the first control is performed in such a manner that a bucket actuation command signal is generated with reference to the data table shown in FIG. 9B or FIG. 10B, the generated bucket actuation command signal is outputted to the bucket control valve 16, and the bucket control valve 16 is controlled. Thus, when the detected boom operation direction is a lifting direction and the detected bucket operation direction is a dump direction, the bucket control valve 16 is controlled so that the bucket hydraulic cylinder 6 is actuated in the tilt direction (step 107). The case in which the bucket operation lever 12 is in the dump operation state is included in addition to the case in which the bucket operation lever is in the neutral state because where the bucket operation lever abuts against the dump stopper 3*d*, the bucket 4 is actuated in the direction (tilt direction) different from the direction intended by the operator (dump direction).

Meanwhile, when it is determined in step 106 that the boom operation direction is neutral or a lowering direction ("neutral or a lowering direction" determination in step 106), the second control is performed in such a manner that a bucket actuation command signal is generated with reference to the data table shown in FIG. 9(*c*) or FIG. 10C, the generated bucket actuation command signal is outputted to the bucket control valve 16, and the bucket control valve 16 is controlled. Thus, when the detected boom operation direction is neutral or a lowering direction and the detected bucket operation direction is a dump direction, the bucket control valve 16 is controlled so as to restrict the actuation speed of the bucket hydraulic cylinder 6 in the dump direction (step 109).

FIG. 8 shows by way of example control trajectories (1) and (2) in the case the first control illustrated by step 107 is performed and control trajectories (3) (boom neutral) and (4) (boom lowering) in the case the second control illustrated by step 109 is performed.

Thus, as shown in the control trajectory (1) in FIG. 8, where the regions AR2, AR1 are entered in a state in which the bucket 4 is neutral operated and the boom 3 is lift operated, the pressure oil is gradually supplied to the bottom chamber 6B of the bucket hydraulic cylinder 6 and the bucket 4 is gradually operated in the tilt direction.

As shown in the control trajectory (2) in FIG. 8, where the regions AR2, AR1 are entered in a state in which the bucket 4 is dump operated and the boom 3 is lift operated, the pressure oil is gradually supplied to the bottom chamber 6B of the bucket hydraulic cylinder 6 and the bucket 4 is gradually operated in the tilt direction.

As shown in the control trajectory (3) in FIG. 8, where the regions AR2, AR1 are entered in a state in which the bucket 4 is dump operated and the boom 3 is neutral operated, the limitation on the pressure oil supplied to the head chamber 6H of the bucket hydraulic cylinder 6 is gradually increased and the actuation of the bucket 4 in the dump direction is gradually restricted.

As shown in the control trajectory (4) in FIG. 8, where the regions AR2, AR1 are entered in a state in which the bucket 4 is dump operated and the boom 3 is lowering operated, the limitation on the pressure oil supplied to the head chamber 6H of the bucket hydraulic cylinder 6 is gradually increased and the actuation of the bucket 4 in the dump direction is gradually restricted.

Figure 2A:
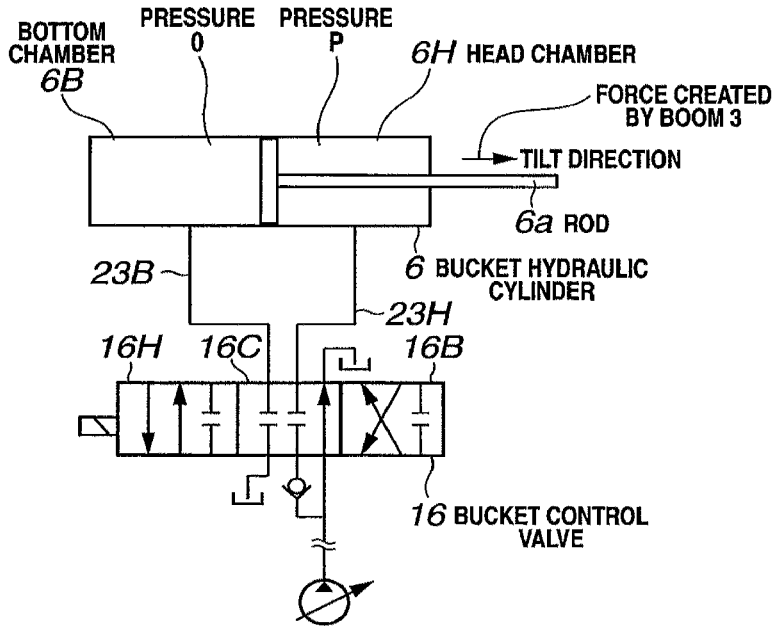
RELATED ART FIG.2A
FIGS. 2A and 2B are used to illustrate the actuation of the conventional bucket hydraulic cylinder.
Figure 2B:
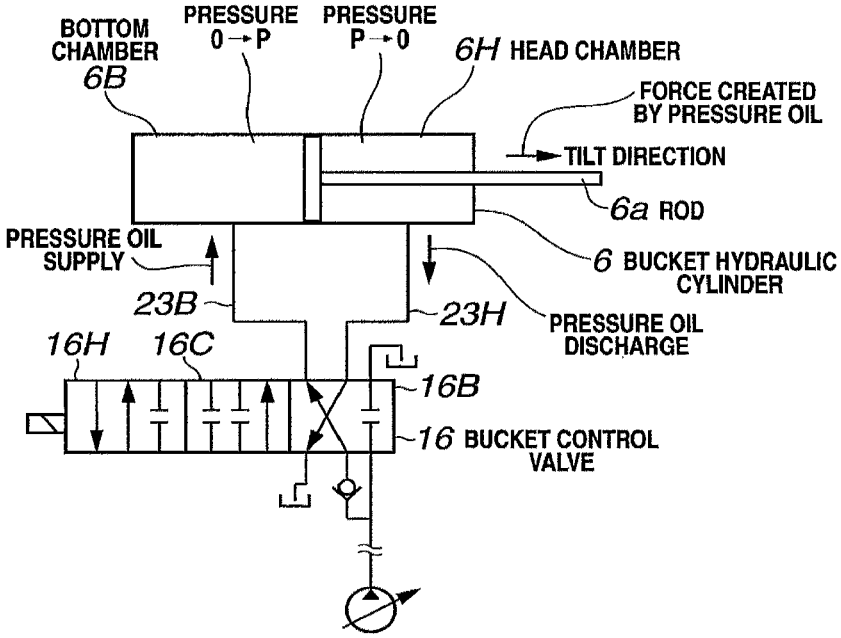
Figure 3A:
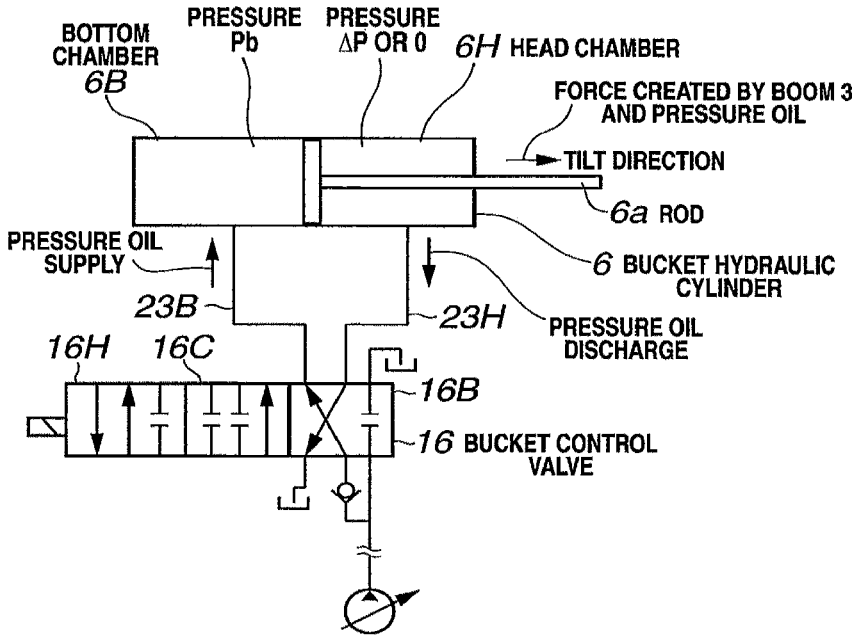
FIGS. 3A and 3B are used to illustrate the actuation of the bucket hydraulic cylinder according to the embodiment in comparison with FIGS. 2A and 2B.
Figure 3B:
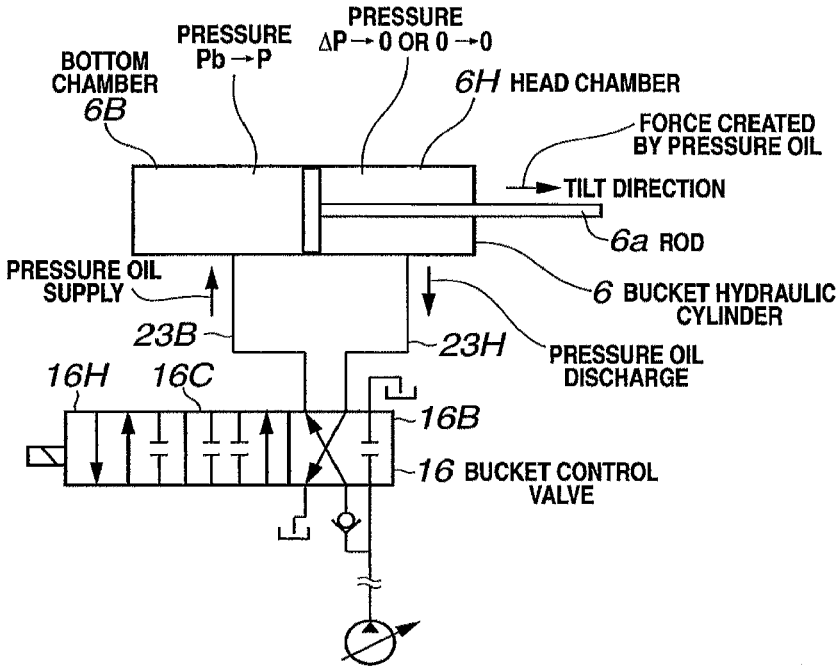

The results of the present embodiment can be explained by using FIGS. 3A and 3B in comparison with the conventional results shown in FIGS. 2A and 2B.

(Effect of the First Control)

FIG. 3A shows the state of the bucket hydraulic cylinder 6 in the case in which the first control has been performed according to the data tables shown in FIG. 9B and FIG. 10B.

Where the first control is performed, the pressure oil is supplied to the bottom chamber 6B of the bucket hydraulic cylinder 6 and a state is assumed in which the head chamber 6H is open. Therefore, the state in which the head chamber 6H of the bucket hydraulic cylinder 6 is open is assumed even if the rod 6*a* of the bucket hydraulic cylinder 6 is drawn out by the force lifting the boom 3 due to the mechanism limit. Therefore, the pressurization of the head chamber 6H is moderated (the pressure ΔP of the head chamber 6H becomes less than P shown in FIG. 2A).

In particular, when the first control is performed according to the data table shown in FIG. 9B, the flow rate of the pressure oil supplied to the bottom chamber 6B of the bucket hydraulic cylinder 6 is increased. As a result, the speed at which the bucket hydraulic cylinder 6 is actuated by the supply of the pressure oil becomes higher than the speed at which the bucket hydraulic cylinder 6 is actuated by the force lifting the boom 3, and the pressurization of the head chamber 6H by the force lifting the boom 3 can be eliminated (pressure in the head chamber 6H is 0).

The pressurization of the bottom chamber 6B of the bucket hydraulic cylinder 6 can thus be moderated or reduced to zero.

Therefore, even if the bucket operation lever 12 is thereafter operated and the bucket 4 is actuated in the tilt direction, abrupt and large variations in the oil pressure that have been conventionally encountered (FIG. 2B) are not generated and smooth variations such as shown in FIG. 3B are realized (bottom chamber 6B; Pb→P, head chamber 6H; ΔP→0 or 0→0). Therefore, vibrations generated in the bucket hydraulic cylinder 6 can be substantially moderated or completely eliminated. As a result, impacts acting upon the vehicle body 1*a* and the operator can be moderated or completely eliminated.

Further, since the forcible drawing of the rod 6*a* of the bucket hydraulic cylinder 6 by the force lifting the boom 3 can be eliminated or moderated, operability and workability are improved.

When the work equipment posture is in the region AR2 or AR1, in combination with supplying the pressure oil to the bottom chamber 6B of the bucket hydraulic cylinder 6, it is possible to perform the control restricting the flow rate of the pressure oil supplied to the bottom chamber 5B of the boom hydraulic cylinder 5 in order to restrict the lifting speed of the boom 3.

The pressurization of the bucket hydraulic cylinder 6 can be further moderated, when the boom 3 is being lifted, by restricting the lifting speed of the boom 3.

(Effect of the Second Control)

Where the second control is performed, the flow rate of the pressure oil supplied to the head chamber 6H of the bucket hydraulic cylinder 6 is reduced and the actuation speed of the bucket hydraulic cylinder 6 in the dump direction is restricted. As a result, the pressurization inside the head chamber 6H of the bucket hydraulic cylinder 6 is moderated. Therefore, even if the bucket operation lever 12 is thereafter operated and the bucket 4 is actuated in the tilt direction, abrupt and large variations in the oil pressure that have been conventionally encountered (FIG. 2B) are not generated and smooth variations are realized, and consequently vibrations generated in the bucket hydraulic cylinder 6 can be substantially moderated or completely eliminated.

The invention claimed is:

1. A control method for a work vehicle that is applicable to a work vehicle of a structure in which a movement of a bucket is restricted by abutment of a work equipment constituted by the bucket against a stopper, whereby the bucket in a dump position is forcibly moved upward toward a tilt direction and a bucket hydraulic cylinder is pressurized by a lifting operation of a boom, wherein control is performed to supply a pressure oil to the bucket hydraulic cylinder so as to actuate the bucket hydraulic cylinder in the tilt direction when the work equipment is being actuated in an actuation region in which the bucket is forcibly actuated in the tilt direction, or in the actuation region close thereto, when lifting the boom in a state in which the bucket is operated at a position corresponding to a stopped position or to a bucket operation direction corresponding to a dumping operation position.

2. The control method for a work vehicle according to claim 1, wherein control is performed to limit a lifting speed of the boom in combination with control performed to supply the pressure oil to the bucket hydraulic cylinder.

3. A control apparatus for a work vehicle of a structure in which a movement of a bucket is restricted by abutment of a work equipment constituted by the bucket and a boom against a stopper, whereby the bucket in a dump position is forcibly actuated in a tilt direction and a bucket hydraulic cylinder is pressurized by a lifting operation of the boom, the control apparatus comprising:

a bucket control valve that controls a direction and a flow rate of a pressure oil supplied to the bucket hydraulic cylinder;

boom detection means for detecting an angle or a height of the boom;

bucket cylinder stroke detection means for detecting a stroke of the bucket hydraulic cylinder;

boom operation direction detection means for detecting an operation direction of the boom;

bucket operation direction detection means for detecting an operation direction of the bucket;

storage means for storing an actuation region in which the bucket is forcibly actuated in a tilt direction and an actuation region close to this actuation region, in association with a work equipment posture specified by the boom angle or height and the bucket cylinder stroke; and control means for controlling the bucket control valve so as to actuate the bucket hydraulic cylinder in the tilt direction when the work equipment posture specified by the detected boom angle or height and the detected bucket cylinder stroke is within the actuation region in which the bucket is forcibly actuated in the tilt direction or within the actuation region close to this actuation region, as determined with reference to the storage means, and when the detected boom operation direction is a lifting direction and the detected bucket operation direction is a dump direction or the actuation of the bucket is stopped.

4. The control apparatus for a work vehicle according to claim 3, further comprising a boom control valve that controls a direction and a flow rate of the pressure oil supplied to the boom hydraulic cylinder, wherein the control means controls the boom control valve so as to restrict also a lifting speed of the boom.

5. A control method for a work vehicle that is applicable to a work vehicle of a structure in which a movement of a bucket is restricted by abutment of a work equipment constituted by the bucket and a boom against a stopper, whereby the bucket in a dump position is forcibly actuated in a tilt direction and the bucket hydraulic cylinder is pressurized by a lifting operation of the boom, the control method comprising:

a first determination step of determining that a boom angle is greater than a predetermined value and a stroke necessary for the bucket hydraulic cylinder to reach a dump stopper end is less than a predetermined value;

a second determination step of determining that a boom operation direction is a lifting direction and a bucket operation direction is a dump direction or the actuation of the bucket is stopped, and also determining that the boom operation direction is a lowering direction or the actuation of the boom is stopped and the bucket operation direction is the dump direction; and a step of performing control to supply a pressure oil to the bucket hydraulic cylinder so as to actuate the bucket hydraulic cylinder in the tilt direction when the boom angle is determined to be greater than the predetermined value and the stroke necessary for the bucket hydraulic cylinder to reach the dump stopper end is determined to be less than the predetermined value as a result of the first determination step, and the boom operation direction is determined to be the lifting direction and the bucket operation direction is determined to be the dump direction or the actuation of the bucket is stopped as a result of the second determination step, and of controlling the pressure oil supplied to the bucket hydraulic cylinder to restrict an actuation speed of the bucket hydraulic cylinder in the dump direction when the boom angle is determined to be greater than the predetermined value and the stroke necessary for the bucket hydraulic cylinder to reach the dump stopper end is determined to be less than the predetermined value as a result of the first determination step, and the boom operation direction is determined to be the lowering direction or the actuation of the boom is stopped and the bucket operation direction is determined to be the dump direction as a result of the second determination step.

* * * * *